US006918810B1

(12) United States Patent
Brewer, Jr.

(10) Patent No.: US 6,918,810 B1
(45) Date of Patent: Jul. 19, 2005

(54) TOOL FOR CLOSING A STUFFED TOY

(76) Inventor: Jimmy D. Brewer, Jr., P.O. Box 2016, Houma, LA (US) 70360

( * ) Notice: Subject to any disclaimer, the term of this patent is extended or adjusted under 35 U.S.C. 154(b) by 0 days.

(21) Appl. No.: 10/685,980

(22) Filed: Oct. 15, 2003

Related U.S. Application Data

(63) Continuation-in-part of application No. 10/278,112, filed on Oct. 22, 2002.

(51) Int. Cl.[7] ..... A63H 3/02

(52) U.S. Cl. ..... 446/369; 294/3.6; 294/99.2; 24/429

(58) Field of Search ..... 294/3.6, 99.2, 294/100, 26; 24/429, 421, 425; 81/488; 446/472, 369–372

(56) References Cited

U.S. PATENT DOCUMENTS

| | | | | | |
|---|---|---|---|---|---|
| 1,889,475 | A | * | 11/1932 | Henkel | 294/99.2 |
| 2,579,207 | A | * | 12/1951 | Scheib | 29/766 |
| 2,663,588 | A | * | 12/1953 | Scheldorfer | 294/3.6 |
| 2,928,157 | A | * | 3/1960 | Deering | 294/3.6 |
| 3,104,568 | A | * | 9/1963 | Patton | 72/311 |
| 3,153,269 | A | * | 10/1964 | Berry | 24/400 |
| 3,167,981 | A | * | 2/1965 | Kern | 294/99.2 |
| 3,354,520 | A | * | 11/1967 | Morgen | 294/3.6 |
| 3,367,336 | A | * | 2/1968 | Eizenberg | 606/210 |
| 4,009,899 | A | * | 3/1977 | Johnson | 294/33 |
| 4,081,883 | A | | 4/1978 | Ishii et al. | |
| 4,139,928 | A | | 2/1979 | Aoki et al. | |
| 4,215,597 | A | * | 8/1980 | Miller et al. | 29/238 |
| 4,422,220 | A | | 12/1983 | Oda | |
| 4,715,840 | A | * | 12/1987 | Swift | 446/74 |
| 4,768,263 | A | | 9/1988 | Faukuroi et al. | |
| 4,852,929 | A | * | 8/1989 | Shafir | 294/99.2 |
| 5,031,286 | A | | 7/1991 | Kedzierski | |
| 5,603,542 | A | * | 2/1997 | Walker | 294/3.6 |
| 5,884,373 | A | | 3/1999 | Kawamura | |
| 5,896,628 | A | | 4/1999 | Oda | |
| 6,109,196 | A | | 8/2000 | Silber | |
| 6,314,624 | B1 | | 11/2001 | Lin | |
| 6,685,532 | B1 | | 2/2004 | McLean | |

* cited by examiner

*Primary Examiner*—Bena B. Miller
(74) *Attorney, Agent, or Firm*—Kenneth A. Keeling; James E. Hudson, III; Keeling & Hudson L.L.C.

(57) ABSTRACT

A wedge tool for operating a slide fastener having an auto-locking biasing member, the wedge tool having elongated arms and a tapered wedge tip extending from at least one arm toward the opposing arm. The wedge tip releases the slide fastener's auto-locking member at the pull tab hole to permit movement of the slide fastener to close an opening of a stuffed toy animal.

14 Claims, 4 Drawing Sheets

TOOL FOR CLOSING A STUFFED TOY

CROSS-REFERENCE TO RELATED APPLICATIONS

This is a continuation-in-part under 37 CFR 1.53(b) to application Ser. No. 10/278,112, filed on Oct. 22, 2002.

STATEMENT REGARDING FEDERALLY SPONSORED RESEARCH OR DEVELOPMENT

Not Applicable.

BACKGROUND OF THE INVENTION

1. Field of the Invention

This invention relates generally to an apparatus for closing an opening in the skin of a stuffed toy after the toy is filled with stuffing material and specifically a tool to selectively engage and operate the slider of a slide fastener on a closure for a stuffed toy.

2. Description of the Related Art

Stuffed animals and toys are typically formed by filling a sewn fabric skin with a resilient material such as polyester-cellulose fibers alone or along with polystyrene beads or other filler materials, creating a three-dimensional soft and resilient representation of an animal or other toy.

In some custom manufacturing, an injection tube is inserted through the stuffing opening and the stuffing material is then injected or pumped through the tube into the interior of the stuffed toy.

When the stuffed toy is sufficiently filled with stuffing material, the stuffing opening must be closed. In some instances this entails sewing the stuffing opening closed using a sewing machine. This method produces an outside ridge, which is readily apparent on the skin of the finished stuffed toy. It is desirable to eliminate the need for a sewing machine and to eliminate this ridge.

Closing the stuffing opening after the stuffing material is inserted by hand-stitching can be a relatively time consuming and costly procedure. It is desirable that the stuffing opening be closed in such a way that time is saved compared to traditional hand-stitching sewing method.

U.S. Pat. No. 6,109,196 issued to Silber on Aug. 29, 2000 discloses a method of closing that provides openings for stitching, lacing of the stitching filament through the openings prior to stuffing, and pulling the stitching to close the opening after stuffing.

Stuffed objects, such as pillows, are often closed with slide fasteners of a type that can be locked in position, thereby preventing unintended reopening, which would allow stuffing to escape. Various auto-locking slide fasteners are known in the art and include U.S. Pat. No. 4,081,883 issued April 1978 to Ishii et al., U.S. Pat. No. 4,139,928 issued Feb. 2, 1979 to Aoki et al., U.S. Pat. No. 4,422,220 issued December 1983 to Oda, U.S. Pat. No. 4,768,263 issued September, 1988 to Fikuroi, et al., U.S. Pat. No. 5,031,286 issued Jul. 16, 1991 to Kudzierski, U.S. Pat. No. 5,884,373 issued Mar. 23, 1999 to Kawamura, U.S. Pat. No. 5,896,628 issued Apr. 26, 1999 to Oda and U.S. Pat. No. 6,314,624 issued Nov. 13, 2001 to Lin. Each of these patents teaches the use of an integral portion of the slide fastener that permits unlocking the slide fastener. Typically, the slide fastener includes a locking member that is biased to a locked position and a fastener pull that forces the locking member to an unlocked position when a distal end of the fastener pull is moved to a determined position.

A slide fastener having an integral lever for unlocking the slider is not advantageous for a stuffed toy, as such integral unlocking lever would allow a user to readily unlock the slider and open the toy, thereby allowing stuffing material to escape. It is therefore necessary to have an unattached wedge tool to unlock the fastener, which may be removed after use. It is also desirable for an unattached wedge tool to be constructed to pose the least damage to inexperienced users.

BRIEF SUMMARY OF THE INVENTION

The wedge tool of the present invention overcomes many of the shortcomings of the prior art by providing a tool for use in closing an opening used to insert stuffing materials into a stuffed toy. In such stuffed toys, fabric members are first fastened to make a container, the exterior defining the shape of the toy and an interior volume. The container includes an opening in communication with the interior volume. The opening has a first lip and a second lip. A row of teeth of a slide fastener having an auto-lock function are affixed to each of the first lip and the second lip such that closure of the slide fastener completely closes the stuffing opening. The slide fastener is of a type that requires release of a biasing mechanism to permit movement of the fastener. A stuffing apparatus has an injection tube and a means for propelling a stuffing material through the tube. The injection tube is inserted into the opening between the first and second rows of slide fastener teeth and stuffing material is injected into the interior volume of the container through the tube. The tube is then withdrawn. The wedge tool is applied to the locking mechanism of the slide fastener to permit movement thereof. The slide fastener is then closed to draw the rows of teeth into abutment. In this way, stuffing is retained in the interior volume.

The present invention comprises an unattached wedge tool to permit release of a locking slide fastener, thereby preventing inadvertent opening of the stuffed toy.

DESCRIPTION OF THE INVENTION

Figure 1:
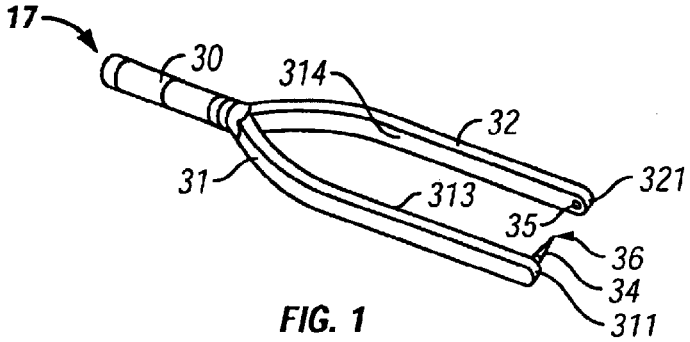
FIG. 1 is a view of the slide fastener positioning wedge tool of the present invention.
Figure 2:
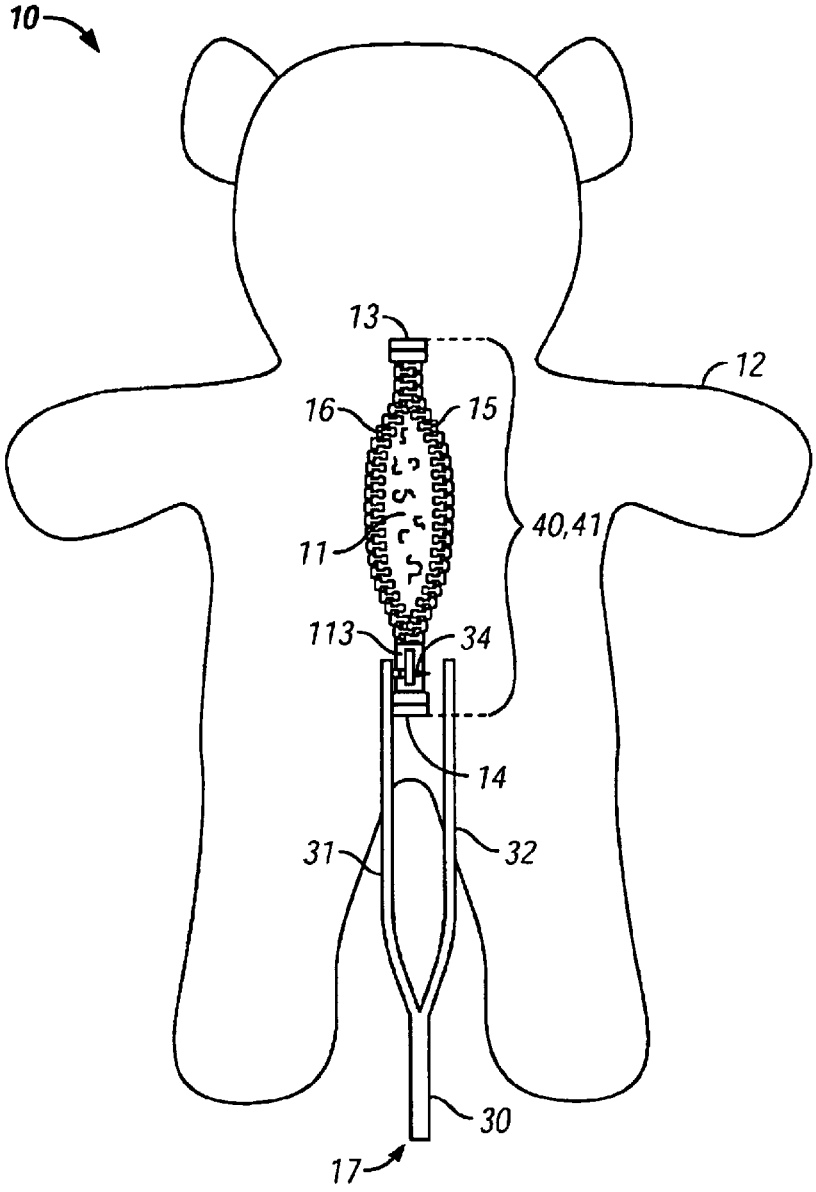
FIG. 2 is a view of a stuffing opening, slide fastener and the wedge tool of the present invention.
Figure 9:
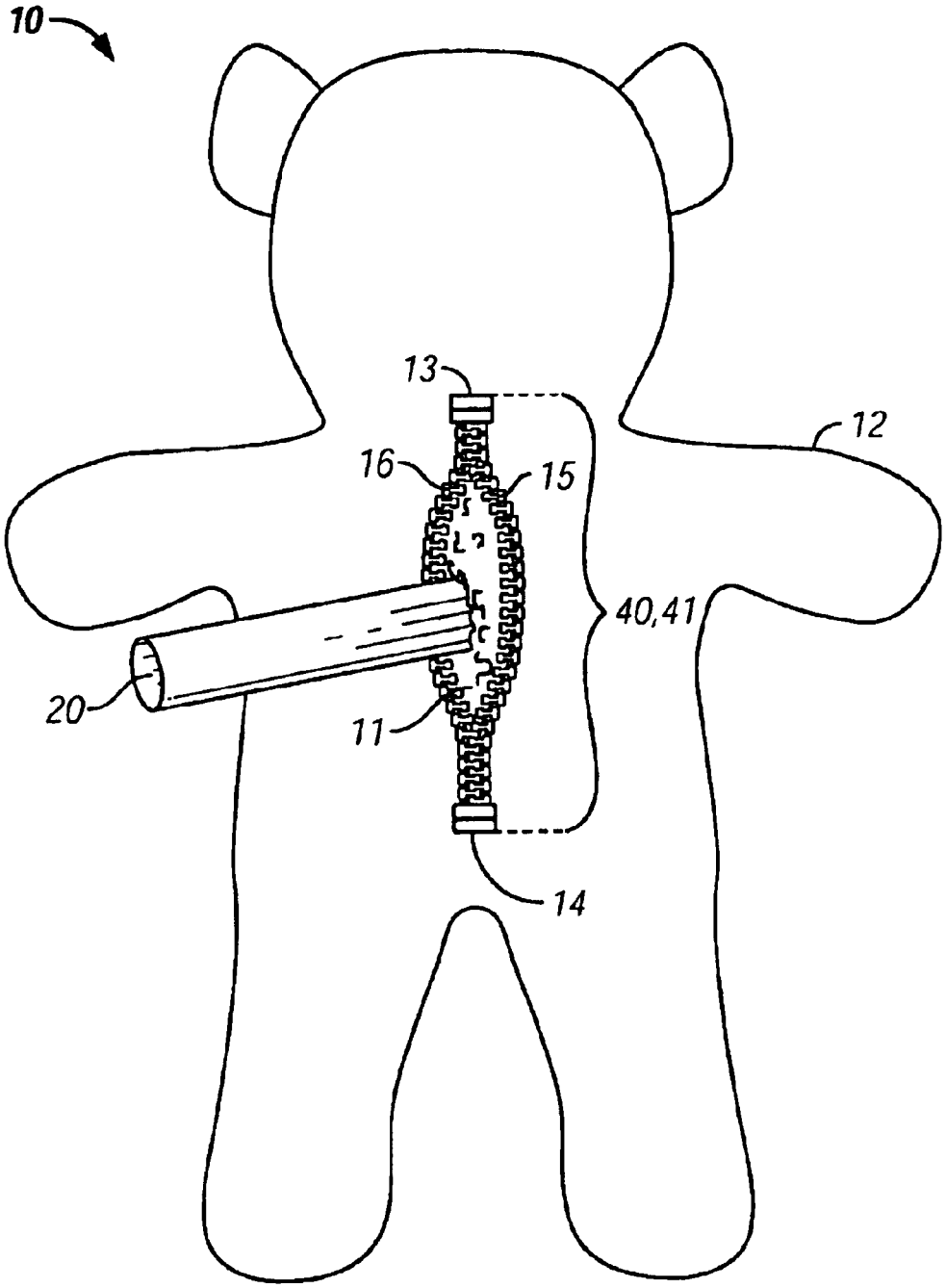
FIG. 9 is a view of a stuffing opening and slide fastener.

FIG. 1 and FIG. 2 depict the wedge tool 17 of the present invention for closing an opening 13 a stuffed toy 10, in this instance a stuffed bear. Referring to FIGS. 2 and 9, a stuffed toy 10 is constructed by filling a sewn fabric container 12, which creates the skin of stuffed toy 10, with a stuffing material 11, which is commonly known in the art. Stuffing opening 13 is left for filling container 12. Container 12 is then filled with stuffing material 11.

Referring to FIG. 9, container 12 is filled with stuffing material 11 using an injection tube 20 inserted through stuffing opening 13 from the outside of the container 12 to the inside. Injection tube 20 is part of a stuffing apparatus that includes a device (not shown) for propelling stuffing material through injection tube 20. Stuffing material 11 is injected through tube 20 into the interior of container 12, thereby filling container 12 with stuffing material 11 and filling out container 12 to a stuffed shape.

Stuffing opening 13 has an exterior closure 40 that is capable of securing the perimeter of stuffing opening 13. Exterior closure 40 is traditionally a sewn seam.

In the exemplary embodiment of the present invention, exterior closure 40 is a slide fastener 41 comprised of slide 14 and two rows of teeth 15 and 16, with the closure 40 operable by a slide fastener 41.

Referring to FIGS. 2 and 9, in the present invention, once container 12 is sufficiently filled with stuffing material 1, tube 20 is withdrawn from stuffing opening 13. Wedge tool 17 is then applied to slide 14 of slide fastener 41, thereby unlocking slide fastener 41 to permit movement. Opening 13 is then closed by movement of slide 14 along the length of slide fastener 41. As will be clear to one of skill in the art, as slide 14 is moved, first row of teeth 15 and second row of teeth 16, are brought securely into abutment, thereby completely closing opening 13.

Slide 14 comprises a type that is normally biased in a locked position, thereby preventing unintended reopening, which would allow stuffing to escape. Various auto-locking slide fasteners are known in the art and include fasteners disclosed in U.S. Pat. No. 4,081,883 issued April 1978 to Ishii et al., U.S. Pat. No. 4,139,928 issued Feb. 2, 1979 to Aoki et al., U.S. Pat. No. 4,422,220 issued December 1983 to Oda, U.S. Pat. No. 4,768,263 issued September, 1988 to Fikuroi, et al., U.S. Pat. No. 5,031,286 issued Jul. 16, 1991 to Kudzierski, U.S. Pat. No. 5,884,373 issued Mar. 23, 1999 to Kawamura, U.S. Pat. No. 5,896,628 issued Apr. 26, 1999 to Oda and U.S. Pat. No. 6,314,624 issued Nov. 13, 2001 to Lin. Each of these patents teaches the use of a biasing mechanism to bias the fastener in a fixed position and further teaches use of an integral portion of the slide fastener, a pull tab, to unlock the slide fastener.

Figure 4:
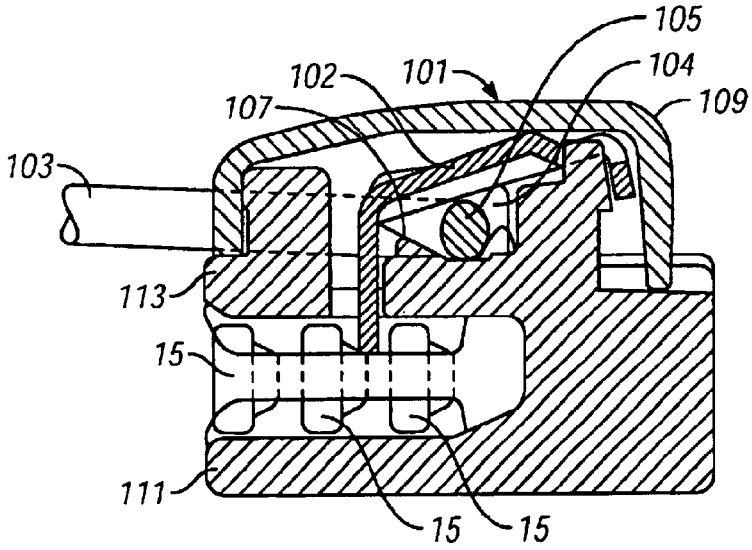
FIG. 4 (Prior Art)
FIG. 4 (prior art) is a cross-sectional view of a representative prior art slide fastener lock mechanism.

Referring to FIG. 4, a representative commercially practiced slide 101 is depicted. Slide 101 includes an upper wing 113, a lower wing 111 and a cover 109. Teeth 15 and teeth 16 (not shown in FIG. 4) are joined between upper wing 113 and lower wing 111 when in a fastened position. A leaf spring 102 prevents movement of fastener 101 along teeth 15 and 16. In operation, leaf spring 102 is raised, allowing movement of fastener 101 along teeth 15 and 16 when pull tab 103 is pulled. Such pulling action causes axle 105 of pull tab 103 in pull tab hole 104 to slide along guide surface 107, thereby forcing leaf spring 102 to move upward from an engaged position to an unengaged position, removed from teeth 15 and 16. Various other prior art fasteners provide means for biasing a blocking mechanism such as leaf spring 102 against the teeth 15 and 16 and further provide means of disengaging such blocking mechanism by operating a pull tab such as pull tab 103.

Referring to FIG. 1, wedge tool 17 of the present invention is depicted. Wedge tool 17 includes a wedge tip 34, a handle 30 and arms 31 and 32. Wedge tool 17 is constructed with arms 31 and 32 spaced apart and extending outward from handle 30. Arms 31 and 32 are constructed of a resilient, yet flexible material to permit end 311 of arm 31 to be moved closer to end 321 of arm 32 by the application of force to the exterior of each arm 31 and 32. Arms 31 and 32 are constructed in a curvilinear manner such that arms 31 and 32 are joined at the ends distal ends 311 and 312, such joined section comprising handle 30.

Arm 31 has an interior surface 313 proximate interior surface 314 of arm 32. Interior surface 313 of arm 31 is provided with wedge tip 34 extending from surface 313 toward surface 314 of arm 32. Arm 31, arm 32, and wedge tip 34 are constructed such that arms 31 and 32 are readily biased toward each other to allow wedge tip 34 to contact surface 314 of arm 32 at a biasing force that could be readily applied by human fingers.

In a preferred embodiment wedge tip 34 is of sufficient width to be wider than a commercially available slide 101. Ends 311 and 312 of arms 31 and 32 are rounded to provide easier access of the wedge tip 34 to the fastener 101.

Referring to FIG. 1, a depression 35 may be provided on interior surface 314 of arm 32 to mate to wedge tip 34 when arms 31 and 32 are forced to a proximate position.

Referring to FIGS. 2 and 4, the use of wedge tool 17 is shown to draw slide 14 along first row of teeth 15 and second row of teeth 16 to close stuffing opening 13. Wedge tip 34 is inserted into slide 14 in pull tab hole 104, otherwise intended for a pull tab 103, disengaging the blocking mechanism that is otherwise biased against teeth 15 and 16. In the exemplary embodiment, wedge tip 34 is inserted between upper wing 113 and leaf spring 102 of slide 14.

A wedge point 36 of wedge tip 34 is relatively small in relation to a typical pull tab axle. Such relatively small size allows for wedge point 36 to be readily inserted into pull tab hole 104 in slide 14, where a pull tab axle 105 would otherwise be placed. The tapered construction of wedge tip 34 between wedge point 36 and arm 31 allows for the wedge tip 34 to be slideably inserted between leaf spring 102 and a segment of the upper wing 113 of slide 14 to force the block mechanism away from teeth 15 and 16 while minimizing the transverse forces against leaf spring 102.

Figure 7:
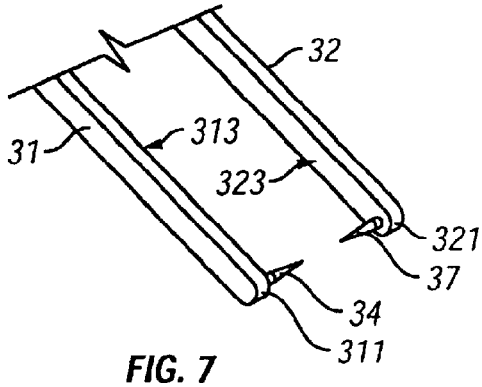
FIG. 7 is a partial view of an alternative embodiment of a wedge tool of the present invention.

Effectively, the tapered construction of wedge tip 34 allows for forcing a blocking mechanism, such as leaf spring 102, into an open position by inserting the wedge tip 34 or opposing wedge tip 37 (shown in FIG. 7 depicting an alternative embodiment of the present invention) transversely to the slide 14. In conventional fasteners, such as fastener 101, the force applied to the blocking mechanism is applied along the axis of potential motion of the slide 101.

Figure 5:
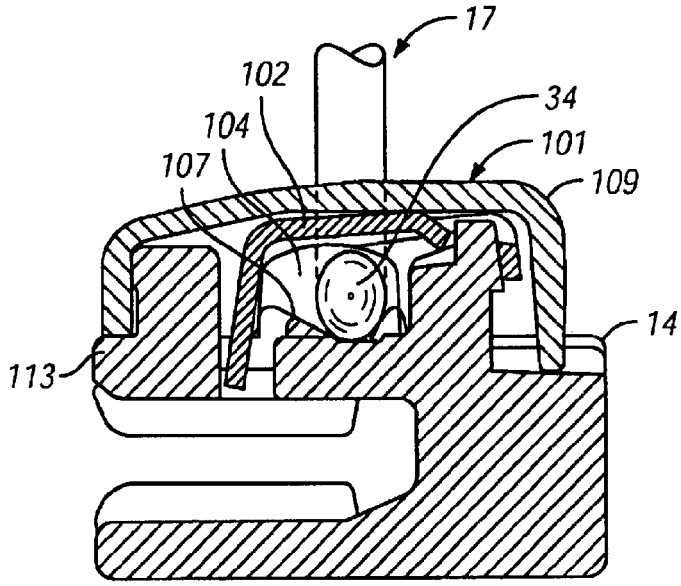
FIG. 5 (prior art) is a cross-sectional view of a representative prior art fastener with the wedge tool of the present invention.

Referring to FIG. 5, an effective application of the present invention is to remove a pull tab 103 from a prior art fastener. Wedge tip 34 of wedge tool 17 is inserted into pull tab hole 104, thereby unlocking the blocking mechanism (such as leaf spring 102).

Still referring to FIG. 5, the operation of the wedge tool 17 of the present invention is shown. A representative prior art fastener 101 is depicted without pull tab 103. Leaf spring 102 would normally be biased against teeth 15 (not shown) and teeth 16 (not shown). In the depiction of FIG. 5, it may be seen that wedge tip 34 is inserted into pull tab hole 104. In the exemplary embodiment, pull tab hole 104 is the opening between upper wing 113 and leaf spring 102, which upon the insertion of wedge tip 34 forces leaf spring 102 away from teeth 15 and 16. Once wedge tip 34 disengages leaf spring 102 from teeth 15 and 16, the user compresses arm 31 and arm 32 towards each other until wedge point 36 contacts arm 32. Wedge tool 17 may then be pulled by a user to move fastener 101 in relation to teeth 15 and 16, thereby opening and closing the opening 13 as required. Wedge tool 17 is also operable to move fastener 101 when wedge point 36 is proximate, but not contacting arm 32.

Figure 6:
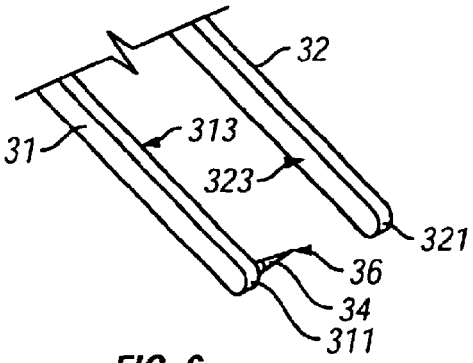
FIG. 6 is a partial view of an alternative embodiment of a wedge tool of the present invention.

Referring to FIG. 6, depression 35 may be omitted from interior 323 of arm 32 to provide a flat surface against wedge tip 34 when arms 31 and 32 are forced to a proximate position.

Figure 3:
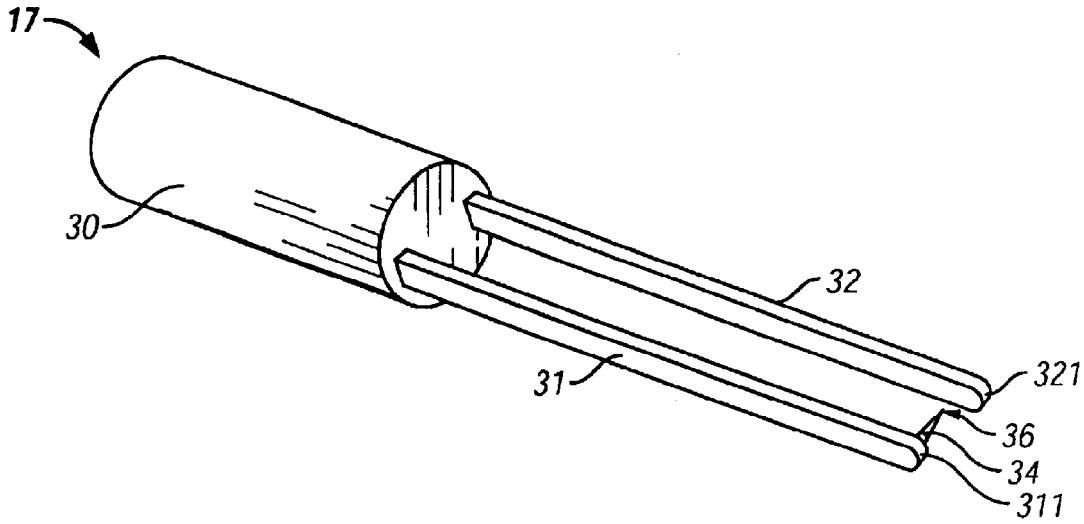
FIG. 3 is a view of an alternate embodiment of a wedge tool of the present invention.

Referring to FIG. 3, a first alternative embodiment of the wedge tool 17 of the present invention is depicted. Arms 31 and 32 are constructed in such a way that arms 31 and 32 are separately joined to handle 30.

In an alternate embodiment depicted in FIG. 7, an opposing wedge tip 37 may be provided on interior 323 of arm 32, so as to be parallel and adjacent to wedge tip 34 when arms 32 and 33 are forced to a proximate position. In such embodiment, opposing wedge tip 37 is also inserted into slide 14, thereby distributing the force of movement through both sides of wedge tool 17. Wedge tool 17 may thereby be used to move slide 14 along the rows of teeth 15 and 16, thereby opening and closing stuffing opening 13. When a desired position of slide 14 is located, the wedge tool 17 may be removed from slide 14 allowing the blocking mechanism (not shown) to engage teeth 15 and 16, thereby preventing further movement of slide 14 along rows of teeth 15 and 16.

Figure 8:
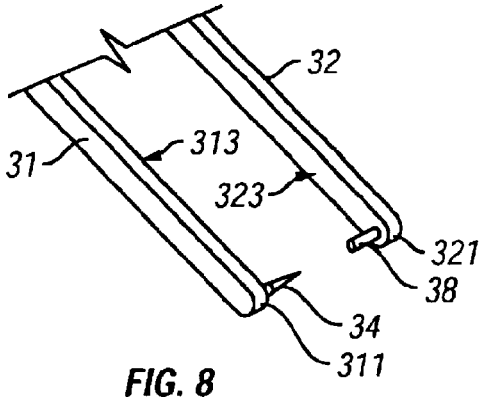
FIG. 8 is a partial view of an alternative embodiment of the present invention having a wedge tip and an extended wedge tip receiver.

In an alternative embodiment depicted in FIG. 8, a wedge tip receiver 38 may be found on interior 323 of arm 32 to mate to wedge tip 34 when arms 31 and 32 are forced to a proximate position.

Referring to FIGS. 7 and 8, opposing wedge tip 37 and wedge tip receiver 38 are each relatively small in relation to a typical pull tab axle 105 (of FIG. 4). Such relatively small size allows for opposing wedge tip 37 or wedge tip receiver 38 to be readily inserted into pull tab hole 104 in slide 14, where a pull tab axle 105 would otherwise be placed. The tapered construction of opposing wedge tip 37 or wedge tip receiver 38 between wedge point 36 and arm 32 allows for the opposing wedge tip 37 or wedge tip receiver to be slideably inserted into pull tab hole 104, between leaf spring 102 and a segment of the upper wing 113 of a slide 14 to force the block mechanism away from teeth 15 and 16, while minimizing the transverse forces against leaf spring 102.

Referring to FIGS. 1, 3 and 6–8, wedge tool 17 may be provided with a decorative handle 30 to associate wedge tool 17 with the source of the stuffed toy or animal.

The foregoing drawings, discussion, and description of the invention is illustrative and explanatory, but are not meant to be limitations on the practice thereof. Various changes in the details of the illustrated construction may be made within the scope of the appended claims without departing from the spirit of the invention. The present invention should only be limited by the following claims and their legal equivalents.

I claim:

1. A wedge tool in combination with a slide fastener of the type having a biasing member for holding the slide fastener in a fixed position in relation to fastener teeth, said wedge tool comprising:

a first elongated arm having a first end and a second end;

a second elongated arm having a first end and second end;

said first arm and said second arm connected at said first arm first end and said second arm first end;

said first arm and said second arm separated at said first arm second end and said second arm second end;

an elongated wedge tip located on said first arm proximate said second end of said first arm; and said wedge tip extending in the direction of said second arm;

said elongated wedge tip sized to engage said biasing member.

2. A wedge tool as in claim 1, further comprising:

said first arm and said second arm flexible to allow said wedge tip to abut said second arm upon application of a closing force.

3. A wedge tool as in claim 1, further comprising:

said wedge tip having a wedge point distal said first arm;

said wedge tip at least partially tapered from said first arm to said wedge point whereby said wedge tip is larger proximate said first arm and smaller proximate said wedge point.

4. A wedge tool as in claim 1, further comprising:

said second arm having a cavity proximate said second end of said second arm;

said cavity capable of receiving said wedge tip.

5. A wedge tool as in claim 1, further comprising:

a second elongated wedge tip located on said second arm proximate said second end of said second arm opposite said wedge tip of said first arm;

said second wedge tip adding in the direction of said first arm.

6. A wedge tool as in claim 1, further comprising:

an elongated wedge tip receiver located on said second arm proximate said second end of said second arm opposing said wedge tip of said first arm;

said wedge tip receiver extending in the direction of said wedge tip;

said wedge tip receiver having an indentation constructed to receive said wedge tip.

7. A wedge tool as in claim 1, further comprising:

a handle provided at said first arm first end and said second arm first end.

8. A wedge tool in combination with a slide fastener of the type having a slide with a biasing member for holding said slide in a fixed position along rows of teeth, said wedge tool comprising:

an elongated first arm including a first free end and a first interior surface;

an elongated second arm including a second free end and a second interior surface;

said first interior surface facing said second interior surface;

a handle attached to said first arm and said second arm distal said first free end and said second free end, respectively;

a wedge tip extending from and normal to said first arm interior side distal said handle;

said wedge tip including a wedge point distal said first arm interior side;

said first free end and said second free end moveable between an open position and a compressed position;

said wedge point and said second arm in said open position defining a gap therebetween; and said wedge point contacting said free end of said second arm in said compressed position;

said wedge point sized to engage said biasing member.

9. A wedge tool as in claim 8, further comprising:

said wedge tip at least partially tapered from said first arm to said wedge point;

said wedge tip being larger proximate said first arm and smaller proximate said wedge point.

10. A wedge tool as in claim 8, further comprising:

said second arm having an indentation in said second arm interior side distal said handle; and said indentation receiving said wedge tip in said compressed position.

11. A wedge tool as in claim 8, further comprising:

a second wedge tip extending from and normal to said second arm interior side distal said handle; and said wedge tip contacting said second wedge tip in said compressed position.

12. A wedge tool as in claim 8, further comprising:

a wedge tip receiver located on said second interior surface; and said wedge tip received by said wedge tip receiver in said compressed position.

13. A wedge tool as in claim 12, further comprising:

said wedge tip receiver extending from and normal to said second interior surface distal said handle.

14. A method of closing a stuffed toy with a wedge tool, said stuffed toy including a closure comprising two rows of teeth, a sliding fastener having a leaf spring and a pull tab hole, and said leaf spring engagable with said two rows of teeth to prevent movement of said sliding fastener, said sliding fastener operable to interlock said two rows of teeth, said wedge tool comprising a first arm and a second arm attached to a handle at a common end, and a wedge tip extending top said second arm from said first arm distal said common end, said method comprising the steps of:

inserting said wedge tip into said pull tab hole to disengage said leaf spring;

compressing said first arm and said second arm together until said wedge tip contacts said second arm;

pulling said compressed wedge tool in a direction to move said sliding fastener;

halting said pulling step when said two rows of teeth are interlocked;

releasing said first arm and said second arm until a space sufficient to remove said wedge tool from said pull tab hole is present; and removing said wedge tool from said pull tab hole.

* * * * *